US005464098A

United States Patent [19]

Tseng et al.

[11] Patent Number: 5,464,098

[45] Date of Patent: Nov. 7, 1995

[54] METHOD FOR MANUFACTURING CONSECUTIVELY OPENED BAG AND BAGGING SYSTEM

[75] Inventors: Ben Tseng, East Brunswick; Peter Chen, Livingston, both of N.J.

[73] Assignee: Inteplast Corporation, Livingston, N.J.

[21] Appl. No.: 310,885

[22] Filed: Sep. 22, 1994

[51] Int. Cl.[6] ..... B65D 83/08

[52] U.S. Cl. ..... 206/554; 383/8; 383/9; 383/37

[58] Field of Search ..... 206/554; 383/8, 383/9, 37

[56] References Cited

U.S. PATENT DOCUMENTS

| | | | |
|---|---|---|---|
| Re. 33,264 | 7/1990 | Baxley et al. | 206/554 |
| 2,715,493 | 8/1955 | Vogt | 229/69 |
| 3,243,937 | 4/1966 | Ragan | 53/384 |
| 4,106,734 | 8/1978 | Walitalo | 248/100 |
| 4,676,378 | 6/1987 | Baxley et al. | 206/554 |
| 4,989,732 | 2/1991 | Smith | 383/37 |
| 5,013,290 | 5/1991 | DeMatteis | 493/196 |
| 5,020,750 | 6/1991 | Vrooman et al. | 248/97 |
| 5,074,674 | 12/1991 | Kuklies et al. | 206/554 |
| 5,087,234 | 2/1992 | Prader et al. | 493/194 |
| 5,125,604 | 6/1992 | Vrooman et al. | 248/97 |
| 5,183,158 | 2/1993 | Boyd et al. | 383/9 |
| 5,188,235 | 2/1993 | Pierce et al. | 383/9 |
| 5,269,605 | 12/1993 | Nguyen | 383/9 |
| 5,307,935 | 5/1994 | Kemanjian | 206/554 |
| 5,333,730 | 8/1994 | Boyd | 206/554 |
| 5,335,788 | 8/1994 | Beasley et al. | 383/37 |
| 5,346,310 | 9/1994 | Nguyen | 383/9 |

*Primary Examiner*—Jimmy G. Foster

*Attorney, Agent, or Firm*—Kenneth P. Glynn; Stephen J. Driscoll

[57] ABSTRACT

A method for manufacturing automatic consecutively opened thermoplastic T-shirt bags for dispensing from a conventional supporting rack. The method involves providing a continuous flattened tube of thermoplastic film and applying adhesive solution using a printing press to form adhesion regions on the outside of the tube. The adhesive solution can be applied using a flexo or gravure printing process. The method then involves forming side gussets in the tube and making traverse seals in the tube, thereby dividing the tube into pillowcases. The pillowcases are separated at the seals to form a series of end-sealed gussetted pillowcases which are stacked to form a bag pack. Next, the bag pack is cut along a bag-mouth contour to from a plurality of T-shirt bags. The bag-mouth contour forms a set of laterally spaced handles each having a receiving aperture for a conventional support rod of a dispensing rack, a central tab having a mounting aperture, and an open mouth region. The adhesion regions are optimally located below the receiving apertures and above the lowest point of the bag-mouth contour. Finally, slight pressure is applied to the proximate area of the adhesion regions of each bag in the bag pack to form a disengageable link between consecutive bags. The invention also relates to the T-shirt bags and the bag packs produced from this method.

20 Claims, 10 Drawing Sheets

METHOD FOR MANUFACTURING CONSECUTIVELY OPENED BAG AND BAGGING SYSTEM

BACKGROUND OF THE INVENTION

1. Field of the Invention

The present invention relates to a rack mountable T-shirt type handled plastic shopping bag and, more specifically, to a bagging system wherein bags are automatically opened when a preceding bag is removed from the rack. This invention also relates to a method of manufacturing the bags and bag packs.

2. Information Disclosure Statement

T-shirt type handled plastic bags have been commonly used in the grocery and retail product industries in the form of packs of such bags. The bag pack is mounted on a rack for consecutive dispensing of the bags and for holding the bag in an open position for loading articles. A conventional way of providing T-shirt type handled plastic shopping bags is to pack 50, 100 or more bags in a stack and bond the bags together by a hot pin welding. The hot pin usually welds the bags on their central tab which is an integral part of the bag, upwardly extending from the bag mouth. The bag pack is further mounted on a suitable supporting rack which includes at least a pair of lateral spaced support rods and a central mounting wicket to facilitate the bag dispensing. Usually, a finger sweep is made on the central tab to tear off the tab and open the bag mouth for loading merchandise. The QUIKMATE® bag/rack system is an example of a commercially available T-shirt bagging system. When the bag pack is mounted on the dispensing rack, the slippery and blocking nature of thin plastic film makes it difficult to manually open the bag for loading. A need therefore exists to dispense a bag easily while simultaneously and automatically opening and holding the next bag in a position to be loaded.

The prior art teaches various bagging systems to provide for the automatic opening of T-shirt type plastic bags. Different methods such as corona treatment, hot melt adhesives, coextrusion of different materials, etc. have been proposed to facilitate the opening of successive bags mounted on a dispensing rack.

Of these methods, perhaps the hot melt method is the most popular. The major disadvantage of this prior art is that the hot melt adhesive spot size, location, and applied amount is not easily controlled by the gun type applicator. The poor control of spot size and location affects the automatic opening of consecutive bags. For example, the spots must be aimed at a fairly broad area on the bag, such as below the mouth, to insure that the glue hits the bag. Such placement, however, is not optimum for opening a bag and can result in an oblong opening. Moreover, the hot melt gun often creates oversized adhesive spots which in turn produce a thick spot on the bag pack and tear a hole when the bag is pulled forward. Applying too much adhesive not only ruins bags, but also wastes adhesive, thus making the hot melt gun cost ineffective. On the other hand, the glue gun may fail to apply enough adhesive in which case the bag being removed disengages from the next bag before the next bag is opened. Extra slits in the bag's central tabs are often employed to ease the bag's separation from the rack and compensate for the lack of adhesive holding strength. The following is a summary of hot melt disclosures.

U.S. Pat. No. 2,715,493 to Vogt relates to square type handleless bags which are connected by a detachable hot melt adhesive bond. The bonds comprise narrow bands of adhesive at the open top which extend transversely across the entire opposed faces of the side walls of the adjacent bags. Likewise, U.S. Pat. No. 4,106,734 to Walitalo, is also directed to handleless plastic bags which are held in registration by employing a small area of adhesive below the bag mouth of the front ply of each bag. In addition to maintaining the bags in registration, the adhesive serves to partially open the bag mouth as each preceding bag is removed from the bag pack. The adhesive means used in both these disclosures, however, suffers the shortcomings mentioned above such as a lack of control over the position and amount of adhesive applied.

U.S. Pat. No. 4,676,378 and Re. 33,264 to Baxley et al, disclose a bag pack which features automatic opening of consecutive bags during the loading operation. Although Baxley further teaches suspending handle bags from suspension rods and utilizing an adhesive area just below the bag mouth region, the adhesive application technique disclosed is essentially the same technique as in U.S. Pat. No. 4,106,734. In addition to problems associated with hot melt adhesives, the Baxley invention also requires a slit in the central tab under the mounting aperture to insure proper severance form the central support wicket.

U.S. Pat. No. 5,020,750 and 5,125,604 to Vrooman, disclose a system for automatic consecutive opening and dispensing plastic grocery bags. The bag is opened by employing a spot of releasable hot melt adhesive bond below the bag mouth region in conjunction with a specially designed dispensing rack. In these references, the supporting rods of the dispensing rack are either made of two different materials of construction or extended at a predetermined angle such that the supporting rods provide the critical resistive force desired in this system. The releasable adhesive bond is applied by a gun type hot melt applicator. In these two references, the special designed dispensing rack is critical to the performance of consecutive bag opening. Moreover, these references have the same disadvantages as U.S. Pat. No. 4,676,378 such as poor control of the spot size, spot location, and amount of an adhesive.

U.S. Pat. No. 5,183,158 to Boyd et al., disclose a bag pack which features automatic opening of consecutive bags during the loading operation. The technique disclosed in this prior art is much the same as disclosed in U.S. Pat. No. 4,106,734 which speaks of suspending handle bags from suspension rods and utilizing an adhesive area just below the bag mouth region on the front of each bag in the bag pack. Boyd also teaches, however, adding another adhesive spot near the bottom of the bag, and applying a corona discharge and pressure treatment to the bag pack. These additional adhesion techniques increase the adhesion between the bags and promote fuller opening of individual bags. Nevertheless, other problems associated with the hot melt method remain.

U.S. Pat. No. 5,307,935 to Kemanjian, discloses a bag system for automatic consecutive opening and dispensing. This is accomplished by providing a special configuration for the central tab which has a narrow neck. The tab is partially slit between the neck edges and is adhered to the tabs of adjacent bags by a hot melt adhesive spot applied below the slit. The hot melt adhesive spot is applied by a gun type applicator which has several shortcomings as described above.

Aside from hot melt techniques, other inventions treat the plastic such that the side of one bag adheres to the side of the following bag. For example, U.S. Pat. No. 5,087,234 to Prader, like U.S. Pat. No. 5,183,158 to Boyd et al., discloses a technique of applying a corona discharge treatment to the bag mouth region. The pressure of cutting the bag mouth and handles causes this treatment to form a releasable link between the bags.

U.S. Pat. No. 5,013,290 to DeMatteis, discloses a method for producing sequentially opened T-shirt type plastic bags by utilizing coextruded bags having at least two layers wherein the inside layer has a low coefficient of friction and the outside layer has a high coefficient of friction. The prior art also includes a special means to cut off the front tab of each bag and create, on the rear tab, a slit that is perfectly horizontal and sufficiently close to the edge of the tab. The key characteristics are the relative stickiness and slipperiness of the various layers and the use of only the rear tab to hold the bag on the wicket.

Still other inventions disclosure using machinery to automatically open bags. For example, U.S. Pat. No. 3,243,937 to Ragan, presents an apparatus having an expandable mandrel on a conveyor and guide plate for the opening of square type handleless bags. The bags are connected in a chain by spots of separable adhesives between the sides of the bags near the open end. The series of bags arranged in flat face contact are further opened by the expandable mandrel in the apparatus.

SUMMARY OF THE INVENTION

The present invention relates to a method for manufacturing automatic consecutively opened thermoplastic T-shirt bags for dispensing from a conventional supporting rack. The method involves providing a continuous flattened tube of thermoplastic film and applying adhesive solution using a printing press to form adhesion regions on the outside of the tube. The adhesive solution can be applied using a flexo or gravure printing process. The method then involves forming side gussets in the tube and making traverse seals in the tube, thereby dividing the tube into pillowcases. The pillowcases are separated at the seals to form a series of end-sealed gussetted pillowcases which are stacked to form a bag pack. Next, the bag pack is cut along a bag-mouth contour to from a plurality of T-shirt bags. The bag-mouth contour forms a set of laterally spaced handles each having a receiving aperture for a conventional support rod of a dispensing rack, a central tab having a mounting aperture, and an open mouth region. The adhesion regions are optimally located below the receiving apertures and above the lowest point of the bag-mouth contour. Finally, slight pressure is applied to the proximate area of the adhesion regions of each bag in the bag pack to form a disengageable link between consecutive bags. The invention also relates to the T-shirt bags and the bag packs produced from this method.

BRIEF DESCRIPTION OF DRAWINGS

The features of the present invention, which are believed to be novel, are set forth with particularity in the appended claims. The invention may best be understood by reference to the following description taken in conjunction with the accompanying drawings, wherein like reference numerals identify like elements, and wherein:

DESCRIPTION OF THE PREFERRED EMBODIMENTS

Figure 1:
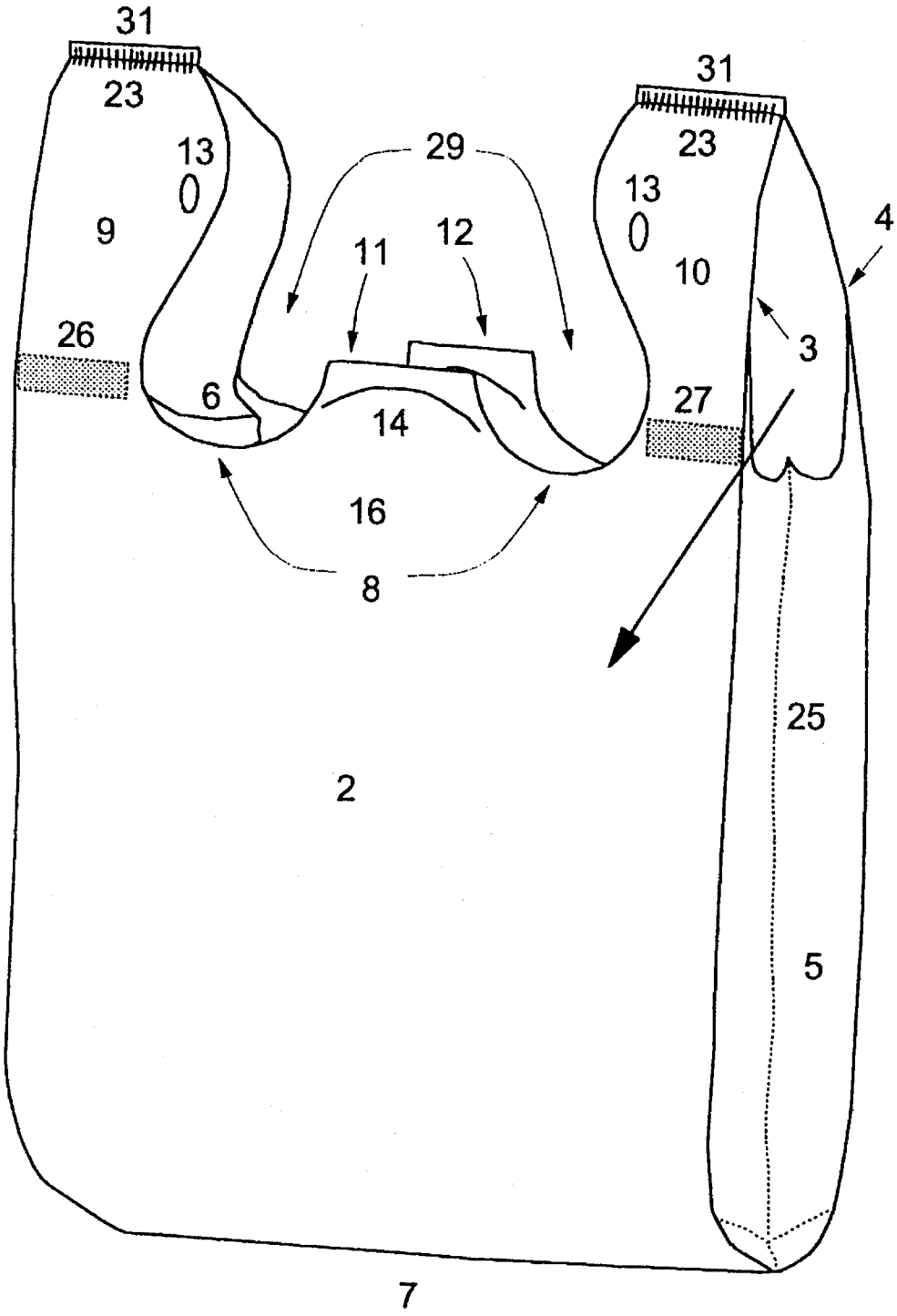
FIG. 1 is a perspective view of a T-shirt type bag of the present invention showing the outline of the bags, the locations of various apertures, and the location for the placement of adhesive for linking successive bags.

Referring to the drawings, FIG. 1 shows a T-shirt type bag 2. Bag 2 has front and rear walls 3, 4 which are integrally connected at sides 5 and 6, sealed at a bottom end 7, and sealed at a top end 31. The walls 3, and 4 also define an open mouth region 8. Laterally spaced handles 9, 10 are integral to walls 3 and 4 and extend upwardly from the mouth region 8 and are sealed at top end 31. Each handle contains a receiving aperture 13 in its intermediate region for receiving supporting rods 17 and 18 of a dispensing rack (see FIG. 4). Although receiving aperture 13 can be any shape, a rounded rectangle shape is preferred to ease threading the bag pack on supporting arms 17 and 18 of the dispensing rack. The location of receiving apertures 13 should be sufficiently beneath the tops of the handles such that the loop handles open to a meaningful extent on supporting rods 17 and 18. Apertures located in the middle of the top and the base of the handles permit such opening. Central tabs 11 and 12 are also integral to walls 3 and 4 and extend upwardly from a central region 16 of the mouth region 8. The upper region of each tab has a crescent-like mounting aperture 14 for receiving a mounting wicket 15 of the dispensing rack (see FIG. 4). When the bag is opened, the central tab 12 helps to support the bag. The central tab 12 also aids in the automatic opening of the bag by holding the rear wall of the bag stationary while the front wall is pulled open. The Bag 2 may also include inwardly folded side gussets 24, 25 (see also FIG. 2), as is the convention with such T-shirt bags. These side gussets form handles 9 and 10 having a double layer of film for added strength.

The bags 2 are preferably made of a lightweight, highly flexible, heat sealable, tough and high mechanical strength thermoplastic material. A suitable plastic film material includes low, linear low, medium, high density polyethylene and mixtures thereof. In addition, materials such as polypropylene, a copolymer of ethylene and another alpha-olefin can also be employed as the film materials.

The handles, central tab, and mouth region are defined by a bag-mouth contour 29. In a preferred embodiment, the bag mouth contour 29 is an ω-shaped curve which is compounded by Cardioid and Hyperbola curves. This shape offers the following advantages: (1) it prevents stress from concentrating on certain points, i.e. the bag will not weaken and/or elongate when pulled to an open position; (2) it avoids forming a V-shaped contour in the panel of gussetted sides 24 and 25 (such V-shaped contours may lead to tear propagation); (3) it provides sufficient space above the bag mouth for the application of disengageable adhesive means; and (4) it creates a handle big enough for carrying a loaded bag.

Figure 3:
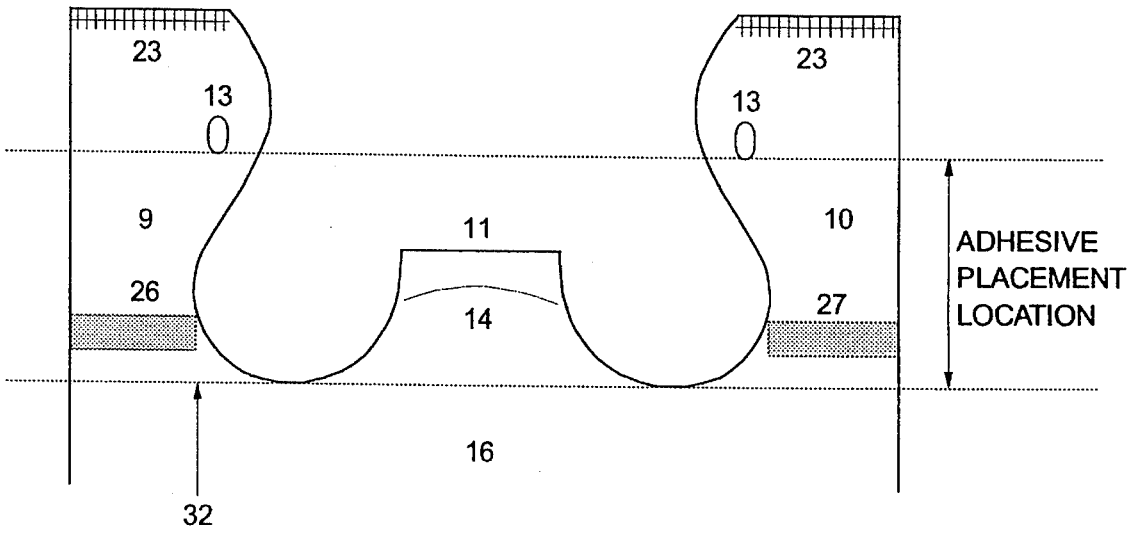
FIG. 3 is an enlarged section of the first embodiment illustrating the placement of adhesive means for linking successive bags
Figure 8:
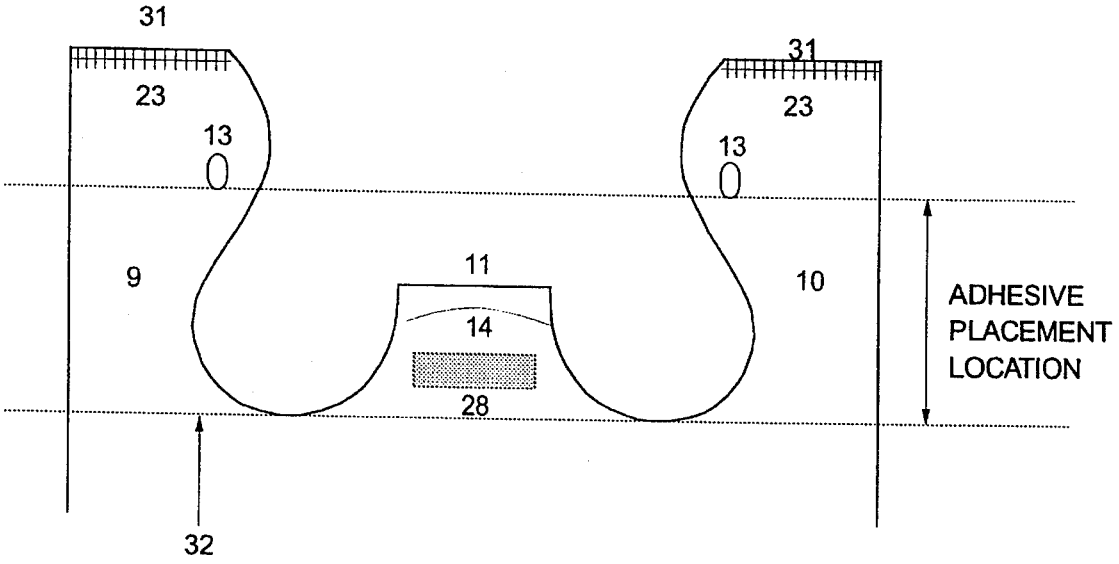
FIG. 8 is a view, like FIG. 3, of the second embodiment of the invention.
Figure 9:
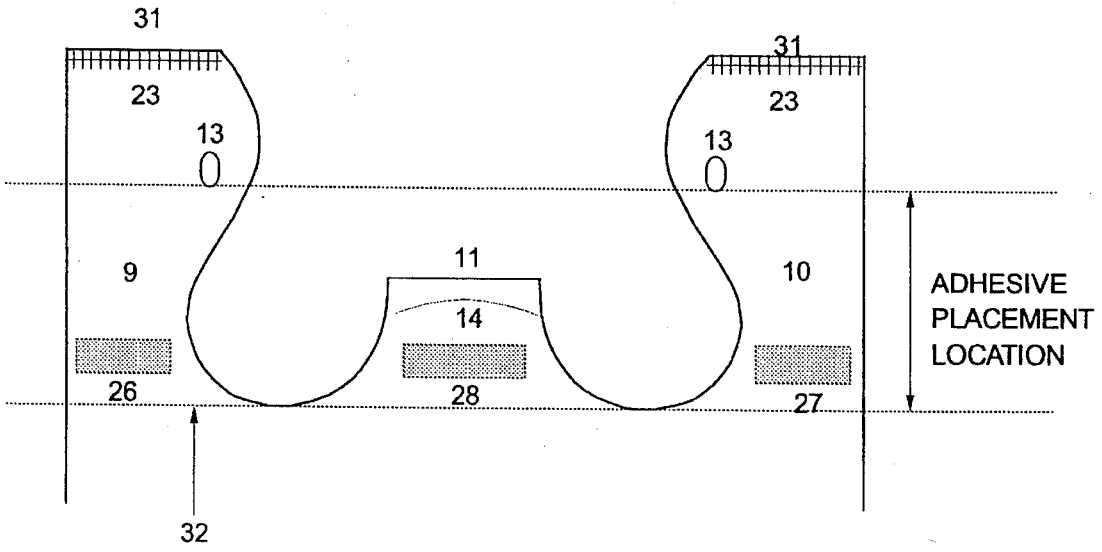
FIG. 9 is a view, like FIG. 3, of the third embodiment of the invention.

Perhaps the most distinguishing aspect of the invention is the deliberate and precise position of adhesive on the bag which improves the reliability of a bag automatically opening. As shown in FIG. 3, 8, and 9 a disengageable adhesive is applied at adhesion regions 26, 27 and/or 28. The optimal region for applying adhesive is above the bag mouth tangent line 32 and either below the receiving aperture 13 of each handle for adhesion regions 26 and 27, or below the mounting aperture 14 of the central tab 11 for adhesion region 28. This optimal positioning facilitates greater opening of the bag because the adhesive link pulls the bag open in the mouth region which is the specific area that a user wants open (i.e., to provide access for loading groceries). It should be noted, however, that it is not necessary to employ all three different adhesion regions as shown in FIG. 9. Adhesion regions 26, 27, and 28 combined or individually can provide sufficient adhesion to automatically open a bag.

These adhesion regions can assume a variety of embodiments including a band across the bag with a width from about ⅛" to about 3". A peel strength provided by an adhesive coating ranging in weight from 0.03 to 0.4 lbs per 1000 square feet is sufficient for the typical supermarket or retail type T-shirt bags. Thus, adhesion regions 26, 27 and 28 having a width of one inch and a length of about two inches will provide sufficient peeling force to ensure the opening of the next bag.

Rather than using the hot melt adhesives which are disclosed in the prior art and commonly used for bonding plastic films, the present invention uses pressure sensitive adhesive solutions, including aqueous and solvent solutions, for their ease of handling and application. Preferred aqueous adhesive emulsions include Tycel A8100 series, sold by Liofol Company in Cary, N.C., and Hydroflex WD 4000 series, sold by H. B. Fuller Company in Saint Paul, Minn., and similar water borne film lamination solutions. The Tycel and Hydroflex aqueous adhesive solutions are optically clear. Consequently, the application of these adhesive solutions do not affect the bag appearance.

Figure 2:
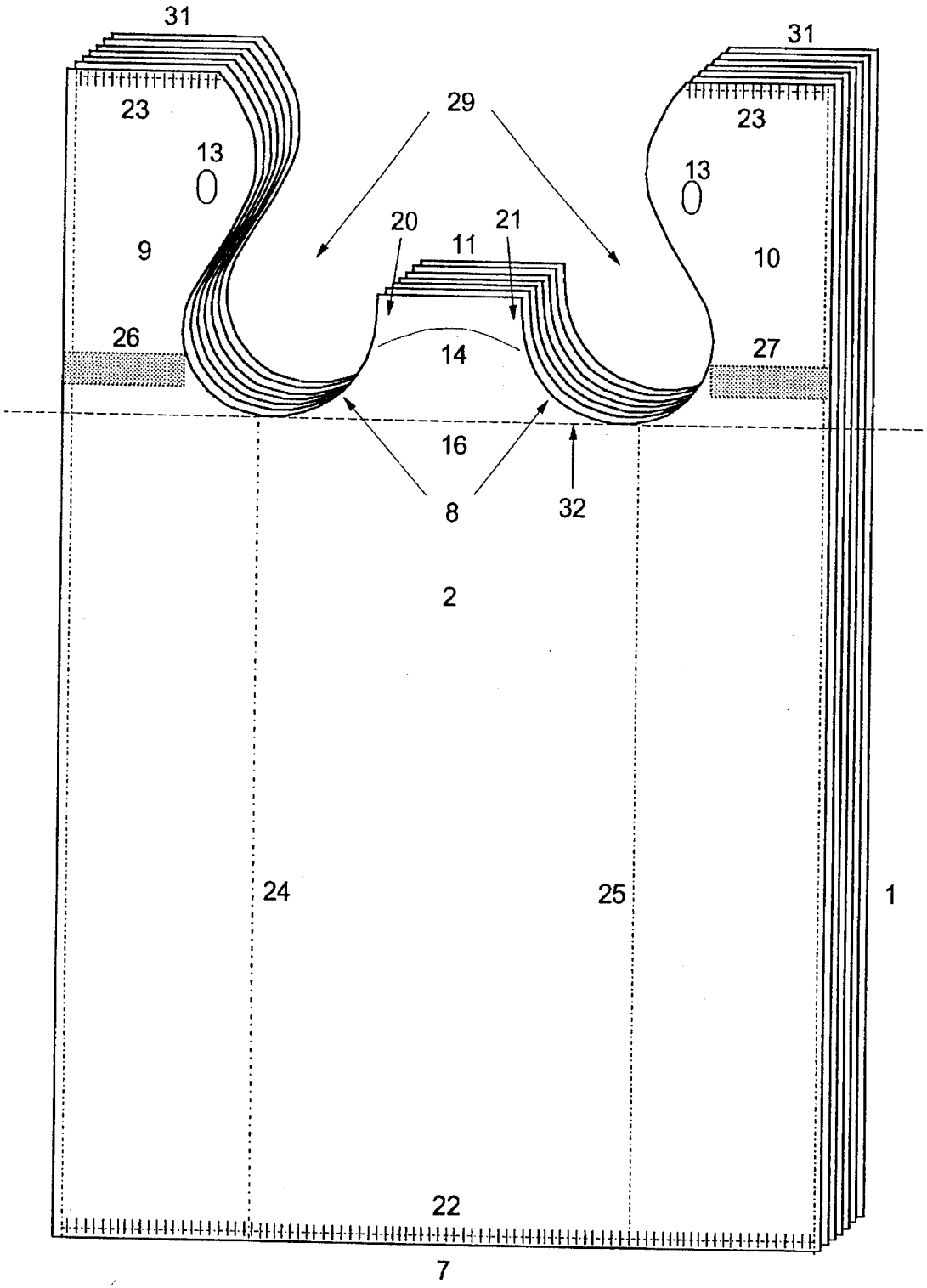
FIG. 2 is a perspective view of a pack of T-shirt type bag pack used in the system of the present invention showing the outline of the bags, the locations of various apertures, and the placement of adhesive for linking successive bags.

As shown in FIG. 2, T-shirt bags are typically used in a bag pack form which comprises a plurality of bags in approximate alignment. Such a bag pack is well known in the industry and provides the user with a convenient and efficient means of installing the bags on the dispensing rack. To form a bag pack, a stack of bags is slightly compressed such that the rear wall of each bag adheres to the adhesion region(s) on the front wall of the next bag. Therefore, these adhesion regions not only facilitate opening the bag, but also keep the bags in alignment to facilitate threading them on the support rods.

Figure 4:
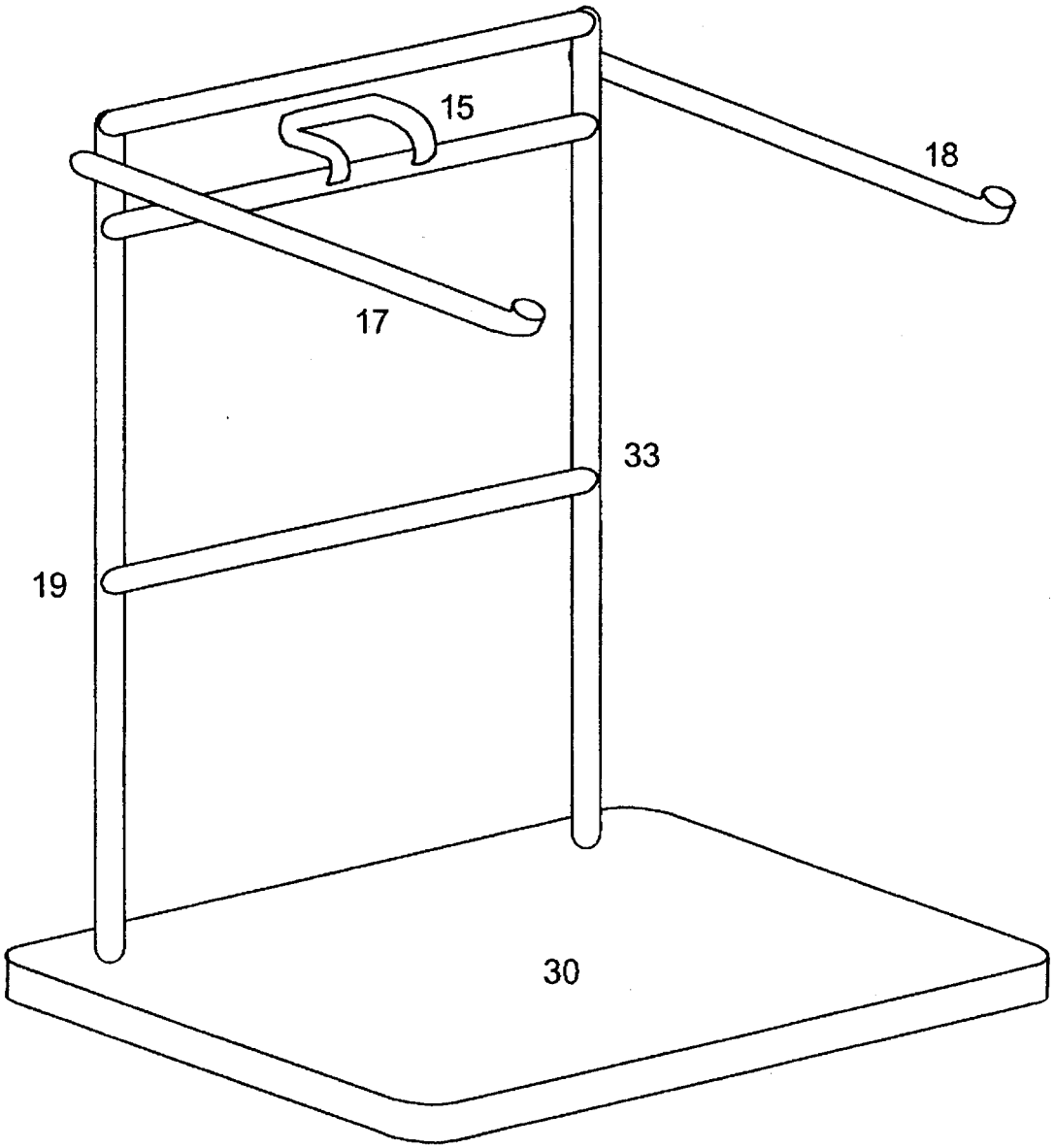
FIG. 4 is a perspective view of a mounting rack employed in the system of the present invention.
Figure 5:
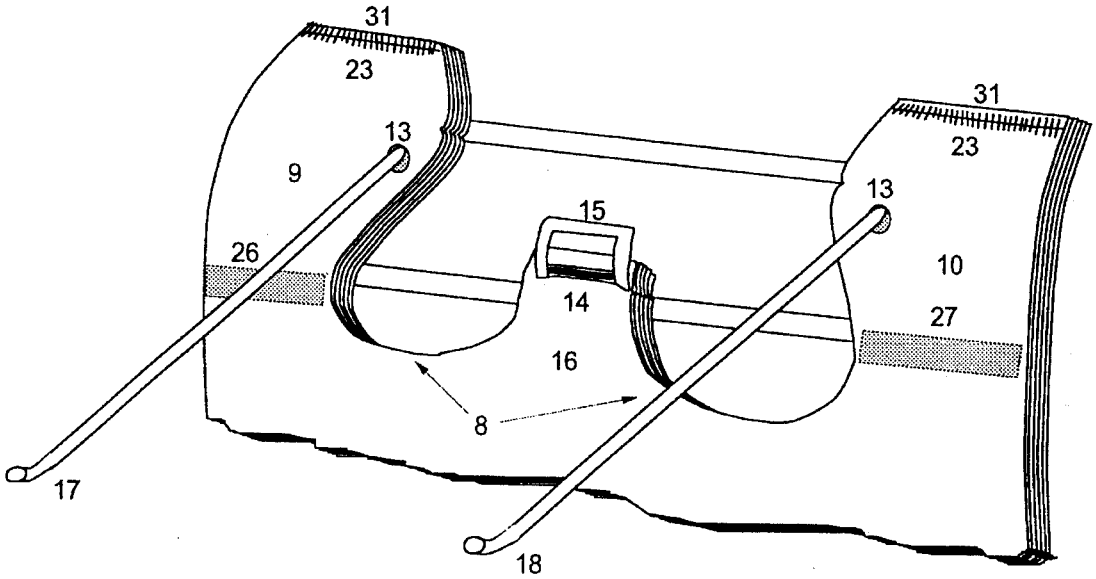
FIG. 5 is a perspective view of the first embodiment illustrating the bag pack of FIG. 2 mounted on the rack of FIG. 4 with the handles engaged with the pair of mounting rods and the tabs engaged with the central hook means.

A conventional bag dispensing rack is shown in FIG. 4 which supports and dispenses bags of the present invention. The rack basically includes two substantially parallel, horizontal, and outwardly extending support rods 17 and 18, which are laterally spaced from each other. The rack also has a mounting wicket 15 between the support rods 17 and 18. Any commercially available dispensing and supporting rack is suitable for the present invention. Indeed, unlike the other systems disclosed in U.S. Pat. Nos. 5,020,750 and 5,125,602, the bagging system in this present invention does not need a specially designed rack to provide resistive force to disengage the adhesive link between adjacent bags.

Figure 6:
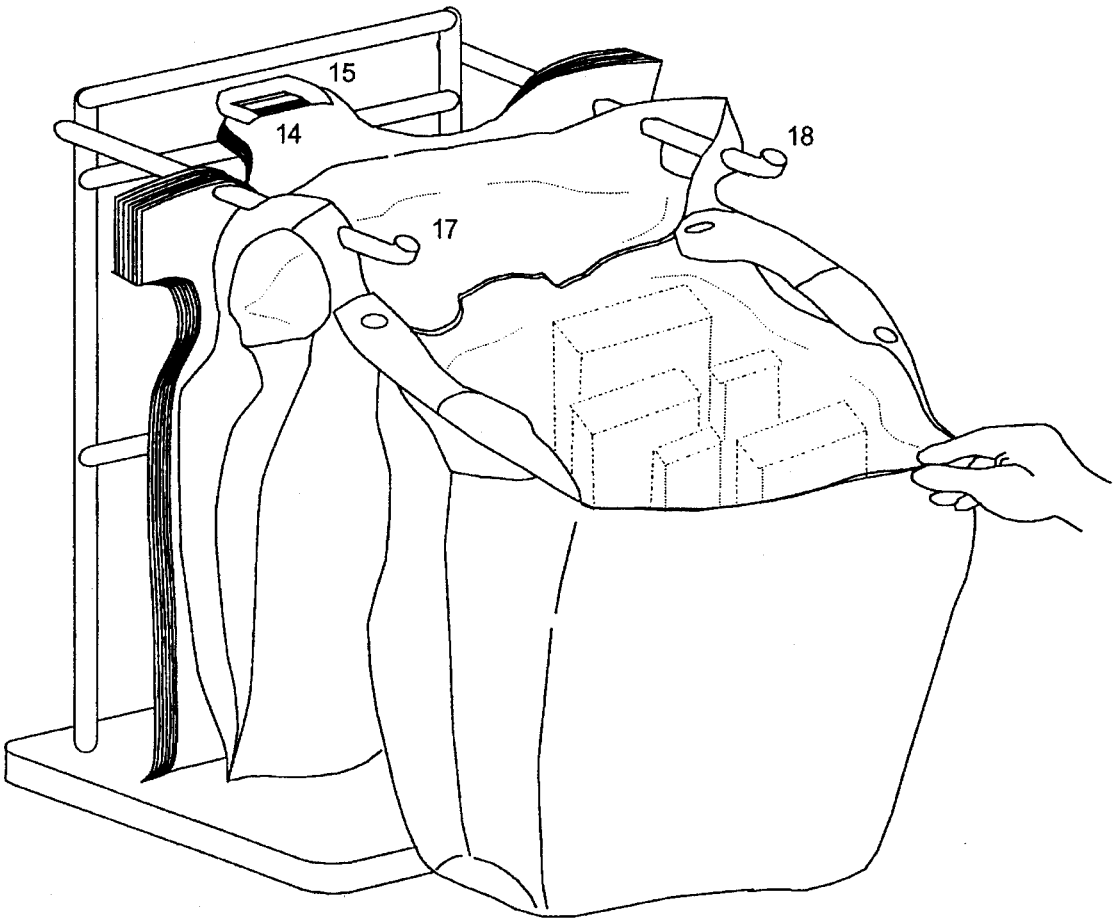
FIG. 6 is a perspective view illustrating a bag forwardly drawn from the bag pack while the handles and central tab are mounted on the bag rack.
Figure 7:
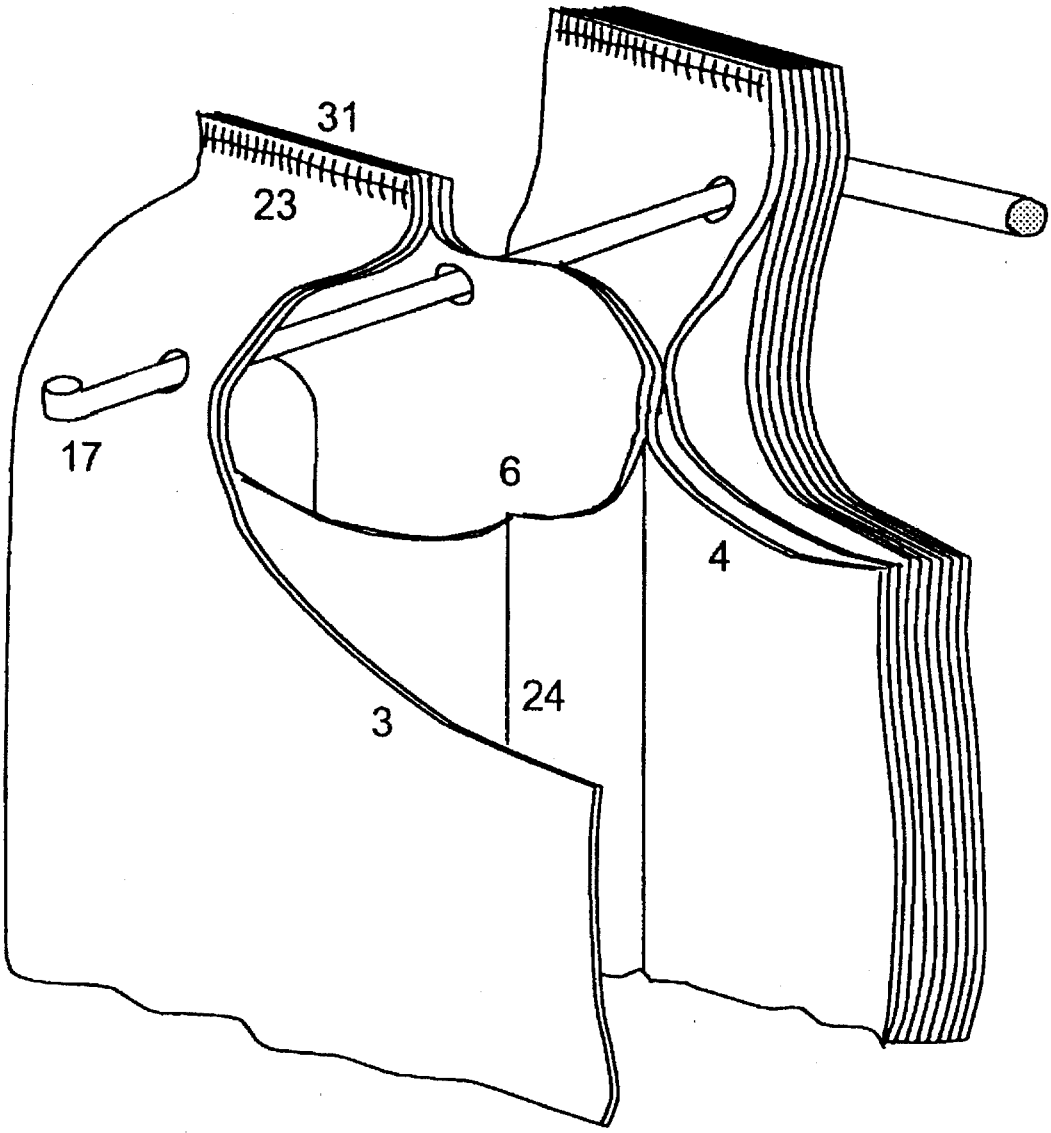
FIG. 7 is a partial perspective view illustrating a bag forwardly drawn from the bag pack and maintained on a support rod in its loading position.

As illustrated in FIG. 6, when a bag is removed from the dispensing rack, it will open the next, consecutive bag. This action can be more accurately described in three steps.

First, when a loaded bag is removed from the rack, the pulling motion disengages the central tab 12 from mounting wicket 15. The front wall 3 of the following bag is simultaneously drawn forward (by the pulling motion of the loaded bag) thereby disengaging the central tab 11 on its front wall from the mounting wicket 15. The central tab on the following bag's rear wall, however, remains on the mounting wicket. The central tabs sever from the mounting wicket 15 because the adhesive's peel strength is greater than the tensile strength of tab ties 20 and 21 on central tab 12. Tab ties 20 and 21 comprise the film remaining from mounting aperture 14 to the mouth region 8. The peel strength of the adhesion regions should only be strong enough to break the tab ties 20 and 21 when the rear wall of the preceding bag is moved a short distance. Although tab ties having a HDPE film thickness ranging from about 0.40 to 1 mil and a width of about one quarter of an inch can be broken easily, the force required to break the adhesive link is also comparatively small. Consequently, the prior art requires an additional perforation line and/or transverse slit under the mounting aperture. This is critical to permit the bag to disengage from the dispensing rack. Such a transverse slit is not necessary in the present invention because the quantity and position of the adhesion regions can be controlled to such a high degree that sufficient peeling strength is insured.

Figure 10:
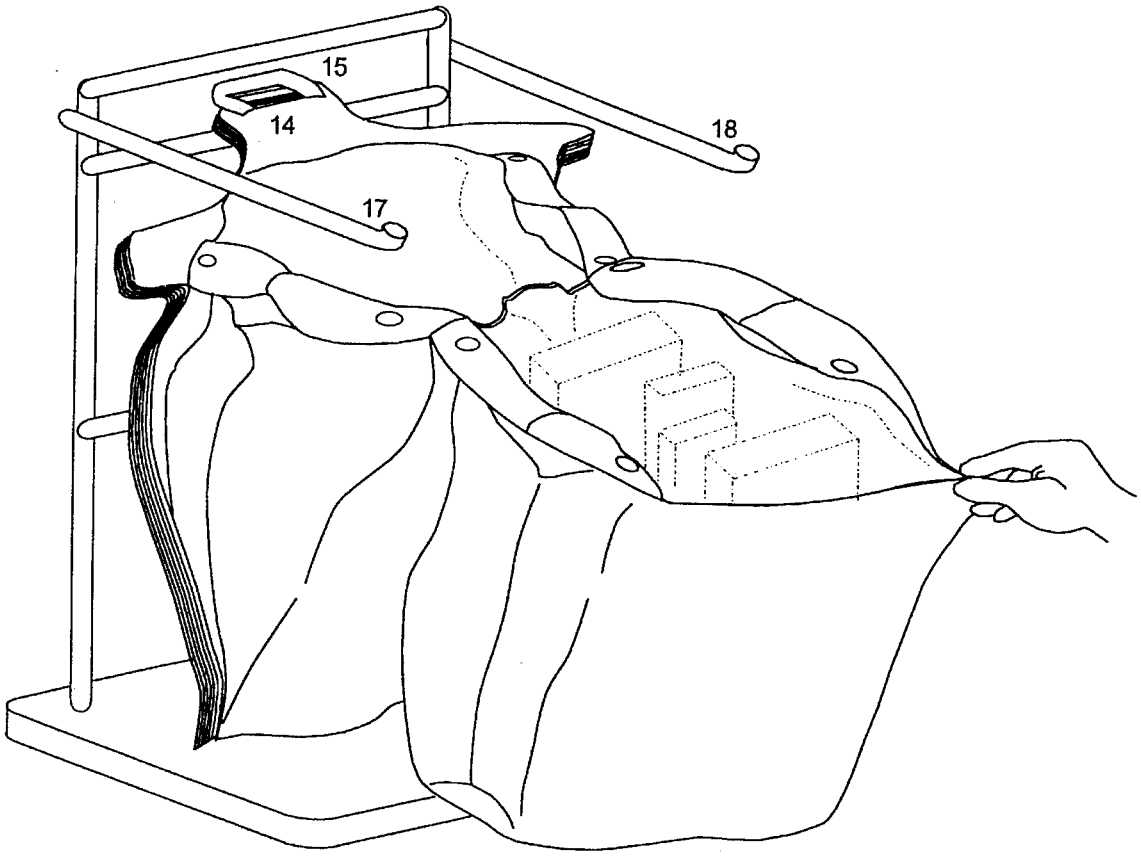
FIG. 10 is a perspective view illustrating a bag forwardly drawn from the bag pack while the handles are not threaded on support rods.

In the second step, the adhesion regions pull the front wall 3 of the following bag. This opens the bag on the support rods 18 and 17. In this loading position, easy access is provided to pack the bag. The present invention also allows the entire bag pack to be supported on mounting wicket 15 through the mounting aperture 14 as shown in FIG. 10, rather than on supporting rods 17 and 18. The bag can be opened with tabs 11 and 12 mounted on the central wicket 15 of the dispensing rack without sacrificing the consecutive self-opening characteristics.

Finally, after the bag is loaded, the bag is pulled forward to disengage its rear wall from the adhesion regions of the following bag, but not before repeating the first step discussed above.

The manufacture of T-shirt bags is well known in the art. These bags are conventionally fabricated from a flattened gussetted thermoplastic tube which is transversely sealed and cut across its width. A heat seal forms both the lower bottom edge 7 of a bag and the upper top edge 31 of the following bag. Such flattened, gussetted, sealed and cut plastic tubes are known as sealed pillowcases in the bag industry.

These pillowcases are stacked upon each other in approximate alignment until the number of pillowcases desired in the bag pack is reached. A suitable cutting means then removes a portion of plastic film from all of the stacked pillowcases at the top end. As shown in FIGS. 1 and 2, the removed portion defines a bag-mouth contour 29 and is designed to simultaneously create integral double loop handles 9 and 10, a bag mouth region 8, and central tabs 11 and 12. In practice, handles having a length of five to seven inches suffice for most T-shirt type bags used in the supermarket. These handles are used to carry the bag when articles and/or groceries are loaded into the bag.

The present invention significantly differs from the prior art in its application and placement of adhesive on the bags. Unlike the prior art which uses glue guns to apply the adhesive, the present invention uses a printing press. Such presses are often used to apply logos or printing, but not for applying glue. To obtain an even and clean-cut adhesive coating, the adhesive solution is applied to the bag by means of either gravure or flexo printing process. The exact position of regions 26, 27 and 28 are controlled by the repeat length of the printing cylinder. Since most bags involve some kind of printing such as a company name or logo, applying the adhesive during this time is efficient and adds no major process requirements.

Taking this innovation into consideration, the resulting process of constructing a pack of mountable gussetted, integrally extended handle thermoplastic bags is as follows:

a. providing a continuous flattened tube of thermoplastic film;

b. applying adhesive using a printing press to form adhesion regions 26, 27 and/or 28 on the outside of the tubes above the bag mouth tangent line 32;

c. forming side gussets 24 and 25 in the tube;

d. making traverse seals 22 and 23 in the tube thereby dividing the tube into pillowcases, each seal defines a bottom end 7 of a pillowcase and a top end 31 of the following pillowcase;

e. separating the pillowcases between the seals 22 and 23 to form a series of end-sealed gussetted pillowcases;

f. stacking the pillowcases in approximate alignment to form a pack;

g. clamping one end of the bag pack to maintain its approximate alignment and cutting through the bag pack along a bag-mouth contour 29 to from a plurality of T-shirt bags, the bag-mouth contour 29 forms a set of laterally spaced handles each having an aperture, a central tabs having a mounting aperture, and an open mouth region; and h. applying slight pressure to the proximate area of the adhesion regions of each bag in the bag pack to form a disengageable link between consecutive bags.

The present invention offers several advantages over the prior art. First, the invention enjoys great control over the placement of the adhesive because the bag is held in close register during the application process. The adhesive can be applied to the relatively narrow target above the lowest point of the bag-mouth contour and below the handle apertures. Such a location facilitates greater opening of the bag because the adhesive pulls the bag open at the mouth which is the specific area a user wants open. Additionally, adhesive can be applied to each handle such that the bag opens in a uniform, square like fashion. On the other hand, the prior art is limited in position accuracy by the hot melt glue gun. This limitation requires that the adhesive be aimed at a broader region to insure that it hits its target. In this case, the broader region represents the body of the bag. Adhesive at such a location, however, fails to open the bag to the extent of the present invention. Furthermore, the glue gun method cannot effectively and efficiently apply adhesive to the handles to provide for the uniform opening of the bag.

Another significant advantage of the present invention is its ability to control the quantity of adhesive applied to the bag. That is, the printing press application method provides for the exact "printing" of the adhesive on the bag. This allows both the thickness and the cross-section of the adhesion region to be controlled. This control allows sizing the adhesion regions to have enough adhesion to disengage the central tab 11 from the central mounting wicket, but not so much adhesion that the bag is pulled off the dispensing rack with the preceding bag. The success rate of bags opening automatically in the present invention is 95% or better. The prior art cannot tailor its adhesion means as accurately. For example, to guarantee that the central tab severs, the prior art uses an extra slit. Furthermore, often there is not enough adhesion and the bags fail to open. A success rate of 85% is considered good in the prior art. Therefore, the present invention's placement and application of adhesive offers significant advantages over the prior art.

Although the present invention has been described with preferred embodiments, modifications and variations may be resorted to those skilled in the art in light of the above teachings, without departing from the spirit and scope of this invention. Such modifications and variations are considered to be within the purview and scope of the appended claims.

What is claimed is:

1. A bagging system to automatically open and dispense consecutive thermoplastic T-shirt-type bags while supporting said bags in an open position to facilitate loading and easy removal of the loaded bags, said system comprises:

a. a bag pack comprising a plurality of stacked T-shirt-type bags in approximate alignment, each bag comprising:

(i) a front and rear wall, the walls are integrally connected at sides, sealed at a bottom end and sealed at a top end, said walls have an open mouth region;

(ii) laterally spaced handles integrally and upwardly extending from each wall on opposite sides, each handle has a receiving aperture in its intermediate region;

(iii) a disconnectable central tab integrally and upwardly extending from each wall at a central area of said mouth region, said central tab has a crescent-like mounting aperture and detachable tab ties, said tab ties have a particular tensile strength;

(iv) disengageable adhesion regions connecting the rear wall of a bag to the front wall of the following bag in said bag pack, said adhesion regions form a disengageable link between consecutive bags of a predetermined peeling strength, said adhesion regions being located on each of said handles; and, b. a mounting and dispensing rack for mounting said bag pack and dispensing of said bags.

2. The system of claim 1 wherein said adhesive solution is a water-borne pressure sensitive adhesive solution.

3. The system of claim 1 wherein said adhesive solution is a solvent-base pressure sensitive adhesive solution.

4. The system of claim 1 wherein said peeling strength is greater than said tensile strength.

5. The system of claim 1 wherein said handles, said central tab, and said mouth region are defined by a bag-mouth contour having an ω-shaped curve.

6. The system of claim 5 wherein said ω-shaped curve is compounded by Cardioid and Hyperbola curves.

7. The system of claim 1 wherein said receiving apertures are formed approximately in the middle of said handles.

8. The system of claim 7 wherein said receiving aperture are a rounded rectangle shape.

9. The system of claim 1 wherein said mounting aperture is a crescent shape.

10. The system of claim 1 wherein said adhesive solution is located on each of said handles below said receiving apertures.

11. The system of claim 1 wherein said mounting and dispensing rack includes:

(i) a generally horizontal base;

(ii) at least two generally vertical frame members mounted on and extending upwardly from said base; and, (iii) at least two laterally spaced generally horizontal support rods extending from the upper portion of said generally vertical frame members.

12. A bag pack produced by the method of manufacturing automatic consecutively opened thermoplastic T-shirt bags for dispensing from a mounting and dispensing rack, which comprises:

a. providing a continuous flattened tube of thermoplastic film;

b. applying adhesive solution using a printing press to form adhesion regions on the outside of said tube in area to subsequently be formed into handles, as set forth below;

c. forming side gussets in said tube;

d. making traverse seals in said tube thereby dividing said tube into pillowcases, each seal defines a bottom end of a pillowcase and a top end of the following pillowcase;

e. separating said pillowcases at said seals to form a series of end-sealed gussetted pillowcases;

f. stacking said pillowcases in approximate alignment to form a bag pack;

g. clamping one end of said bag pack to maintain its approximate alignment and cutting through said bag pack along a bag-mouth contour to form a plurality of T-shirt bags, said bag-mouth contour forms a set of laterally spaced handles each having a receiving aperture, a central tab having a mounting aperture, and an open mouth region; and, h. applying slight pressure to the proximate area of said adhesion regions of each bag in said bag pack to form a disengageable link between consecutive bags.

13. The bag pack of claim 12 wherein said adhesive solution is a water-borne pressure sensitive adhesive solution.

14. The bag pack of claim 12 wherein said adhesive solution is a solvent-base pressure sensitive adhesive solution.

15. The bag pack of claim 12 wherein said adhesive solution is applied by the gravure printing process.

16. The bag pack of claim 12 wherein said adhesive solution is applied by the flexo printing process.

17. The bag pack of claim 12 wherein said central tab is established to have tab ties having a particular tensile strength, wherein said disengageable link has a peeling strength, and wherein said peeling strength is greater than said tensile strength.

18. The bag pack of claim 12 wherein said adhesive solution is applied in the area of said handles below said receiving apertures.

19. The bag pack of claim 12 wherein said bag-mouth contour is an ω-shaped curve.

20. The bag pack of claim 19 wherein said ω-shaped curve is compounded by Cardioid and Hyperbola curves.

* * * * *